US010987929B2

(12) United States Patent
Sue

(10) Patent No.: US 10,987,929 B2
(45) Date of Patent: Apr. 27, 2021

(54) INKJET RECORDING APPARATUS

(71) Applicant: KYOCERA Document Solutions Inc., Osaka (JP)

(72) Inventor: Tomohiro Sue, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/752,814

(22) Filed: Jan. 27, 2020

(65) Prior Publication Data

US 2020/0247122 A1 Aug. 6, 2020

(30) Foreign Application Priority Data

Jan. 31, 2019 (JP) ..... 2019-015556

(51) Int. Cl.
*B41J 2/145* (2006.01)
*B41J 25/34* (2006.01)
*B41J 2/165* (2006.01)

(52) U.S. Cl.
CPC ..... *B41J 2/145* (2013.01); *B41J 2/16517* (2013.01); *B41J 2/16585* (2013.01); *B41J 25/34* (2013.01); *B41J 2/16535* (2013.01)

(58) Field of Classification Search
CPC .. G02B 7/00; G03B 30/00; B41J 2/145; B41J 25/34; B41J 2/2146; B41J 2/16535; B41J 2/16585; B41J 2/16517
See application file for complete search history.

(56) References Cited

U.S. PATENT DOCUMENTS

2017/0232767 A1* 8/2017 Togashi ..... B41J 25/316 347/8
2018/0257393 A1* 9/2018 Sato ..... B41J 25/003
2018/0311983 A1* 11/2018 Saiga ..... B41J 25/316

FOREIGN PATENT DOCUMENTS

JP 2005-011938 A 1/2005

* cited by examiner

*Primary Examiner* — Kristal Feggins
(74) *Attorney, Agent, or Firm* — Studebaker & Brackett PC

(57) ABSTRACT

An inkjet recording apparatus includes a head assembly, an installation base, a positioning member, and a regulation member. The head assembly includes a recording head that ejects ink. The head assembly is installed in the installation base. The positioning member is provided for the installation base and determines a position of the head assembly. The regulation member is provided for the installation base and regulates the position of the head assembly. The regulation member is configured to press the head assembly in a pressing direction. The positioning member protrudes in a direction that intersects with the pressing direction. The head assembly includes an insertion hole into which the positioning member is inserted. The insertion hole is larger in dimension in the pressing direction than the positioning member.

8 Claims, 13 Drawing Sheets

INKJET RECORDING APPARATUS

INCORPORATION BY REFERENCE

The present application claims priority under 35 U.S.C. § 119 to Japanese Patent Application No. 2019-015556, filed on Jan. 31, 2019. The contents of this application are incorporated herein by reference in their entirety.

BACKGROUND

The present disclosure relates to an inkjet recording apparatus.

A linehead type inkjet recording apparatus is one type of ink jet recording apparatus. The linehead type inkjet recording apparatus includes a recording head. The linehead type inkjet recording apparatus conveys a recording medium and ejects ink from the recording head toward the recording medium being conveyed, thereby recording an image on the recording medium. The recording head includes a nozzle surface in which multiple nozzle orifices that allow ink to be ejected therefrom are formed.

In general, the linehead type inkjet recording apparatus includes a head assembly including recording heads in general. The recording heads are arranged in a width direction of a recording medium. Here, the width direction is perpendicular to a conveyance direction of the recording medium. The linehead type inkjet recording apparatus is also configured to eject ink of the same color (one color) from each of the recording heads of the one head assembly. A linehead type inkjet recording apparatus for color printing therefore includes for example four head assemblies. Specifically, this inkjet recording apparatus includes a main body equipped with respective head assemblies for yellow, cyan, magenta, and black colors. The head assemblies for the different colors are arranged side by side in the conveyance direction of the recording medium.

What is needed in the linehead type inkjet recording apparatuses is a more accurate positioning of the recording heads. For example, the recording heads for the different colors having different positions in the width direction of the recording medium may result in a decline in image quality because respective landing positions of ink of the different colors do not match during color printing. Specifically, vertical strips may occur in an image. Therefore, what is needed for installation of head assemblies in a main body of an inkjet recording apparatus is a more accurate positioning of the head assemblies.

SUMMARY

An inkjet recording apparatus according to an aspect of the present disclosure includes a head assembly, an installation base, a positioning member, and a regulation section. The head assembly includes a recording head that ejects ink. The head assembly is installed in the installation base. The positioning member is provided for the installation base and determines a position of the head assembly. The regulation section is provided for the installation base and regulates the position of the head assembly. The regulation section is configured to press the head assembly in a pressing direction. The positioning member protrudes in a direction that intersects with the pressing direction. The head assembly includes an insertion hole into which the positioning member is inserted. The insertion hole is larger in dimension in the pressing direction than the positioning member.

DETAILED DESCRIPTION

Figure 1:
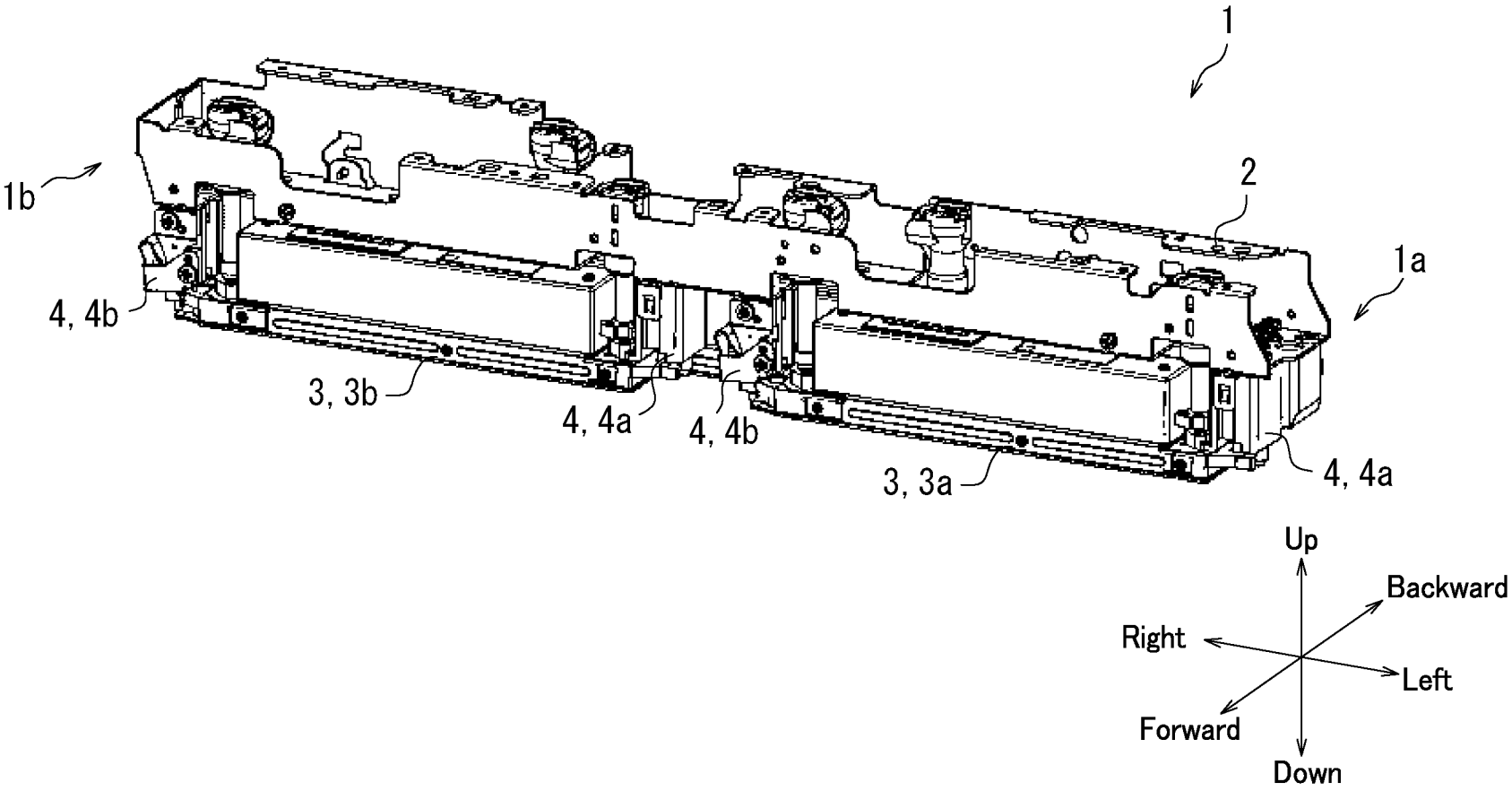
FIG. 1 is a perspective view of a head assembly in an inkjet recording apparatus according to an embodiment of the present disclosure.

An inkjet recording apparatus according to an embodiment of the present disclosure will hereinafter be described with FIGS. 1 to 13. Elements that are the same or equivalent are indicated by the same reference signs in the drawings and description thereof is not repeated. In addition, overlapping description may be omitted as appropriate. Although a front-back direction, a vertical direction, and a left-right direction are described for easy understanding in the drawings, there is no intention to limit these directions as respective directions of a head assembly and an inkjet recording apparatus, when they are manufactured or used, according to an aspect of the present disclosure.

A head assembly 1 included in the inkjet recording apparatus 100 (see FIG. 13) according to the present embodiment will first be described with reference to FIG. 1. FIG. 1 is a perspective view of the head assembly 1 in the present embodiment. Specifically, FIG. 1 illustrates the head assembly 1 as seen diagonally from above front left. As illustrated in FIG. 1, the head assembly 1 includes a base member 2, recording heads 3, and coupling members 4.

The head assembly 1 is an elongated component and includes a first end 1*a* and a second end 1*b* on an opposite side from the first end 1*a*. The first end 1*a* is one end of the head assembly 1 in a longitudinal direction thereof, while the second end 1*b* is the other end of the head assembly 1 in the longitudinal direction. In the present embodiment, the first end 1*a* of the head assembly 1 is a left end thereof and the second end 1*b* of the head assembly 1 is a right end thereof.

The coupling members 4 couple the recording heads 3 to the base member 2. The base member 2 is an elongated member. In the present embodiment, the recording heads 3 include a first recording head 3*a* and a second recording head 3*b*. The head assembly 1 in the present embodiment includes two coupling members 4 for each of the recording heads 3. The two coupling members 4 include a first coupling member 4*a* and a second coupling member 4*b*. The first coupling member 4*a* is located on the left of a corresponding recording head 3 to couple a left end of the corresponding recording head 3 to the base member 2. The second coupling member 4*b* is located on the right of the corresponding recording head 3 to couple a right end of the corresponding recording head 3 to the base member 2. In the present embodiment, a side of the base member 2 on which the recording heads 3 are mounted is a lower side of the base member 2, while the other side is an upper side thereof.

Figure 2:
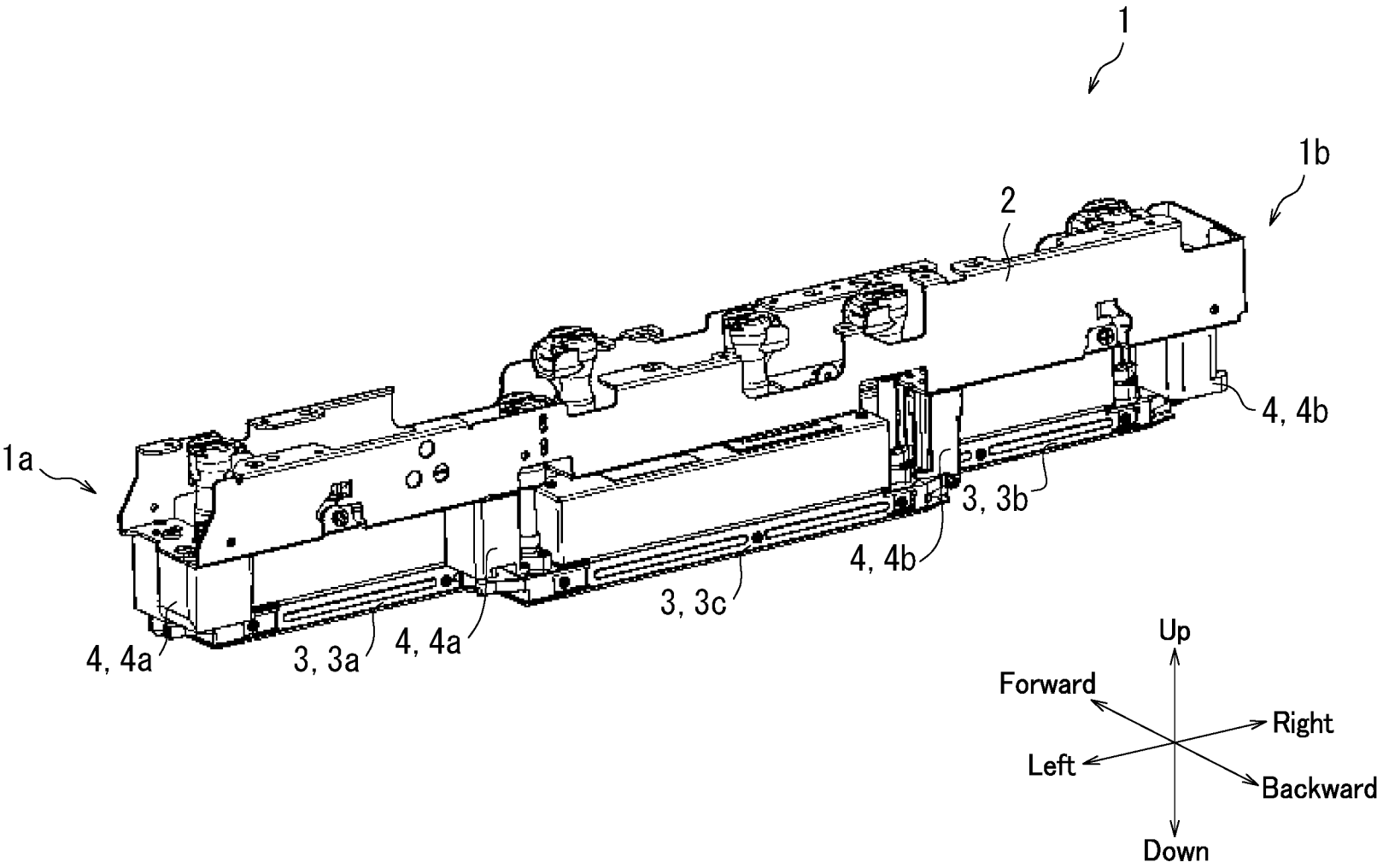
FIG. 2 is a perspective view of the head assembly in the inkjet recording apparatus according to the embodiment of the present disclosure.

The head assembly 1 in the inkjet recording apparatus 100 (see FIG. 13) according to the present embodiment will next be described with reference to FIG. 2. FIG. 2 is a perspective view of the head assembly 1 in the present embodiment. Specifically, FIG. 2 illustrates the head assembly 1 as seen diagonally from above back left. As illustrated in FIG. 2, the recording heads 3 further include a third recording head 3*c*. That is, the head assembly 1 in the present embodiment includes 3 recording heads 3.

In the present embodiment, the first recording head 3*a* is located at a side of the first end 1*a* of the head assembly 1. The second recording head 3*b* is located at a side of the second end 1*b* of the head assembly 1. The third recording head 3*c* is located at a center portion of the head assembly 1. The first to third recording heads 3*a* to 3*c* are mounted on the base member 2 in a staggered pattern in a longitudinal direction of the base member 2. Specifically, the third recording head 3*c* is set further back than the first and second recording heads 3*a* and 3*b*.

Figure 3:
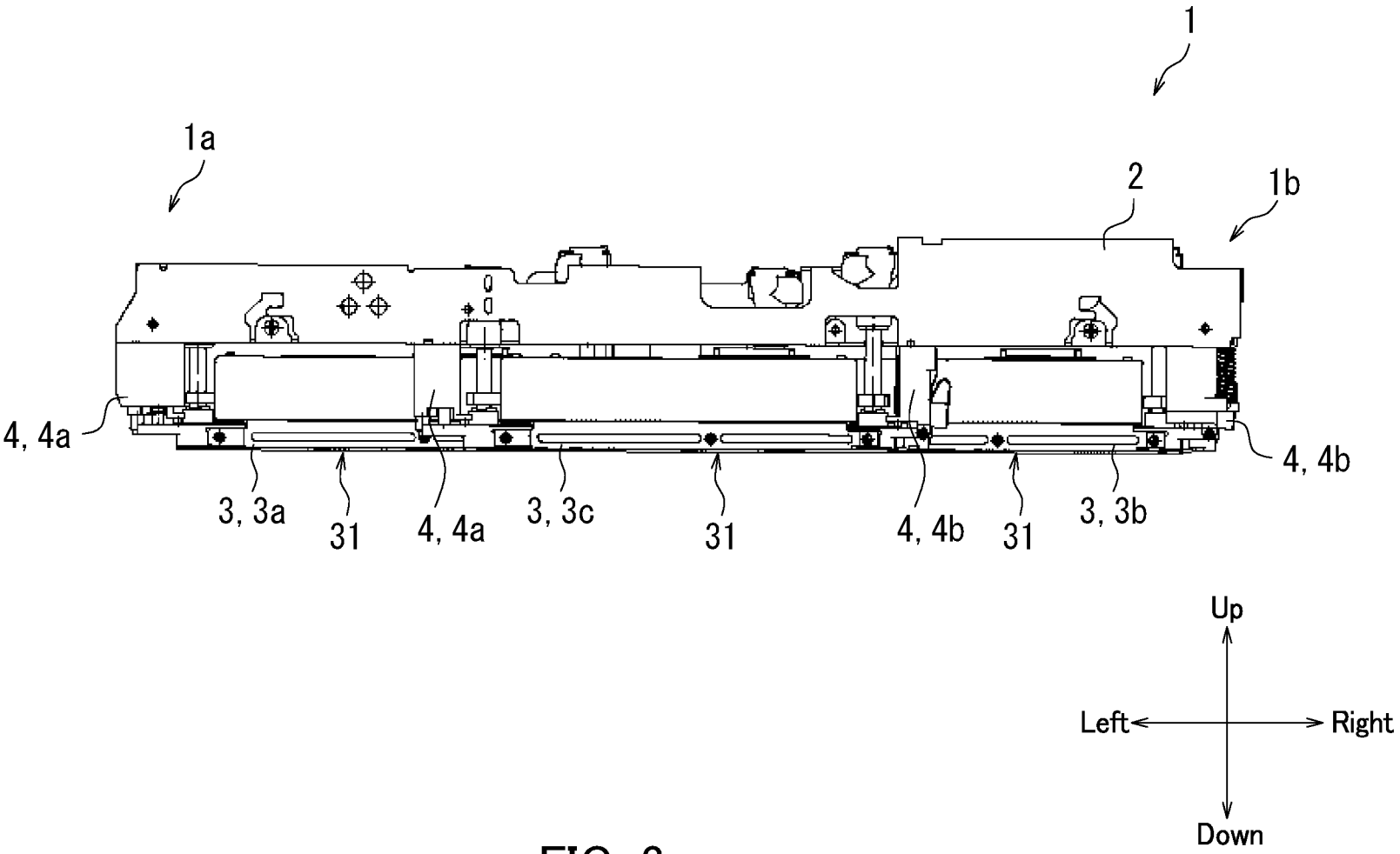
FIG. 3 is a perspective view of the head assembly in the inkjet recording apparatus according to the embodiment of the present disclosure.

The head assembly 1 in the inkjet recording apparatus 100 (see FIG. 13) according to the present embodiment will next be described with reference to FIG. 3. FIG. 3 is a rear view of the head assembly 1 in the present embodiment. As illustrated in FIG. 3, the present embodiment includes 3 recording heads 3, each of which includes a nozzle surface 31. Ink is ejected from each of the nozzle surfaces 31 of the recording heads 3. Specifically, multiple nozzle orifices are formed in each of the nozzle surfaces 31 and ink is ejected from each of the nozzle orifices. Each nozzle surface 31 forms at least part of a lower surface (bottom surface) of a corresponding recording head 3. Note that the first to third recording heads 3*a* to 3*c* eject ink of the same color.

Figure 4:
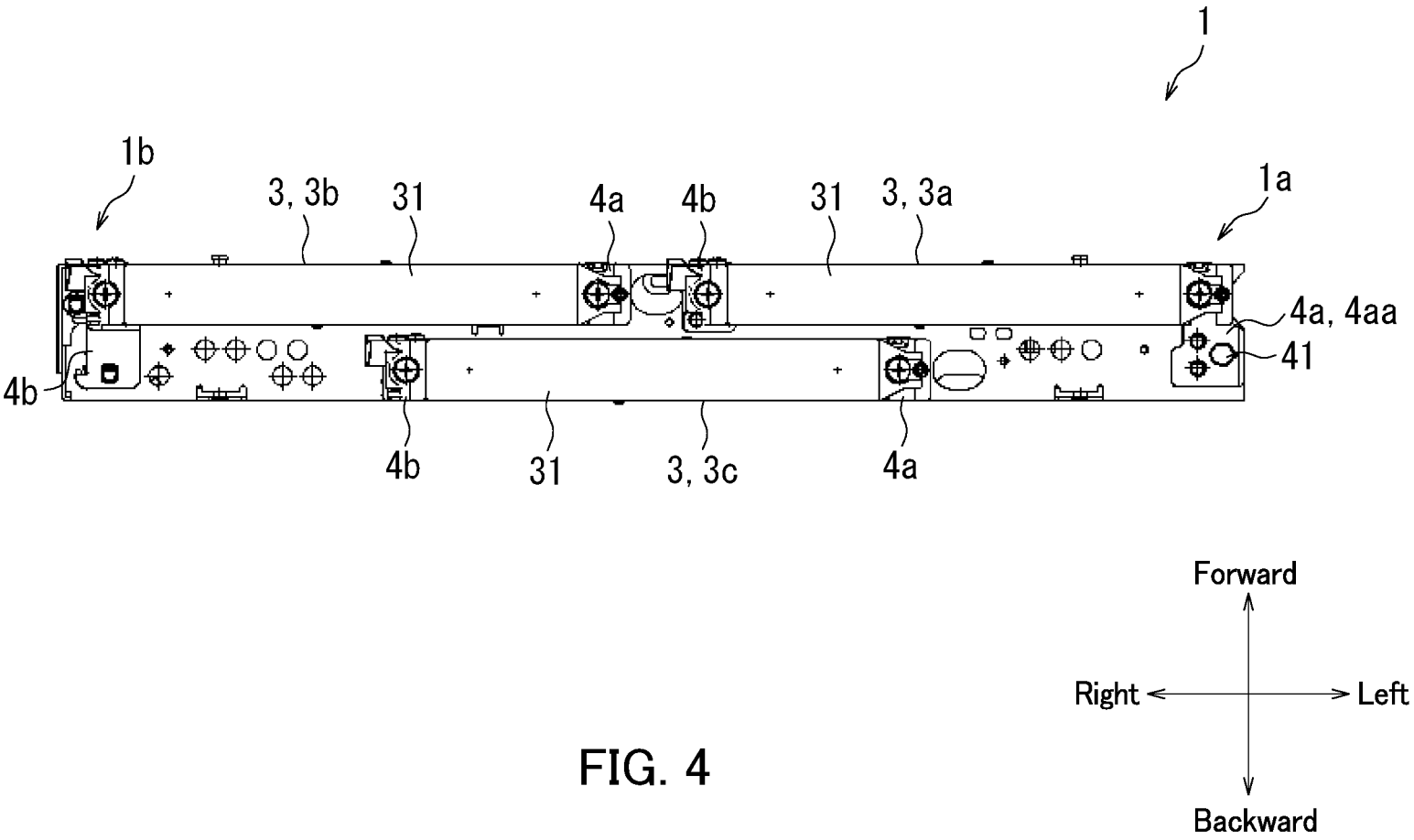
FIG. 4 is a perspective view of the head assembly in the inkjet recording apparatus according to the embodiment of the present disclosure.

The head assembly 1 in the inkjet recording apparatus 100 (see FIG. 13) according to the present embodiment will next be described with reference to FIG. 4. FIG. 4 is a bottom view of the head assembly 1 in the present embodiment. The embodiment includes the recording heads 3, each of which extends in a left-right direction as illustrated in FIG. 4. In other words, each of the recording heads 3 extends in the longitudinal direction of the head assembly 1.

Figure 5:
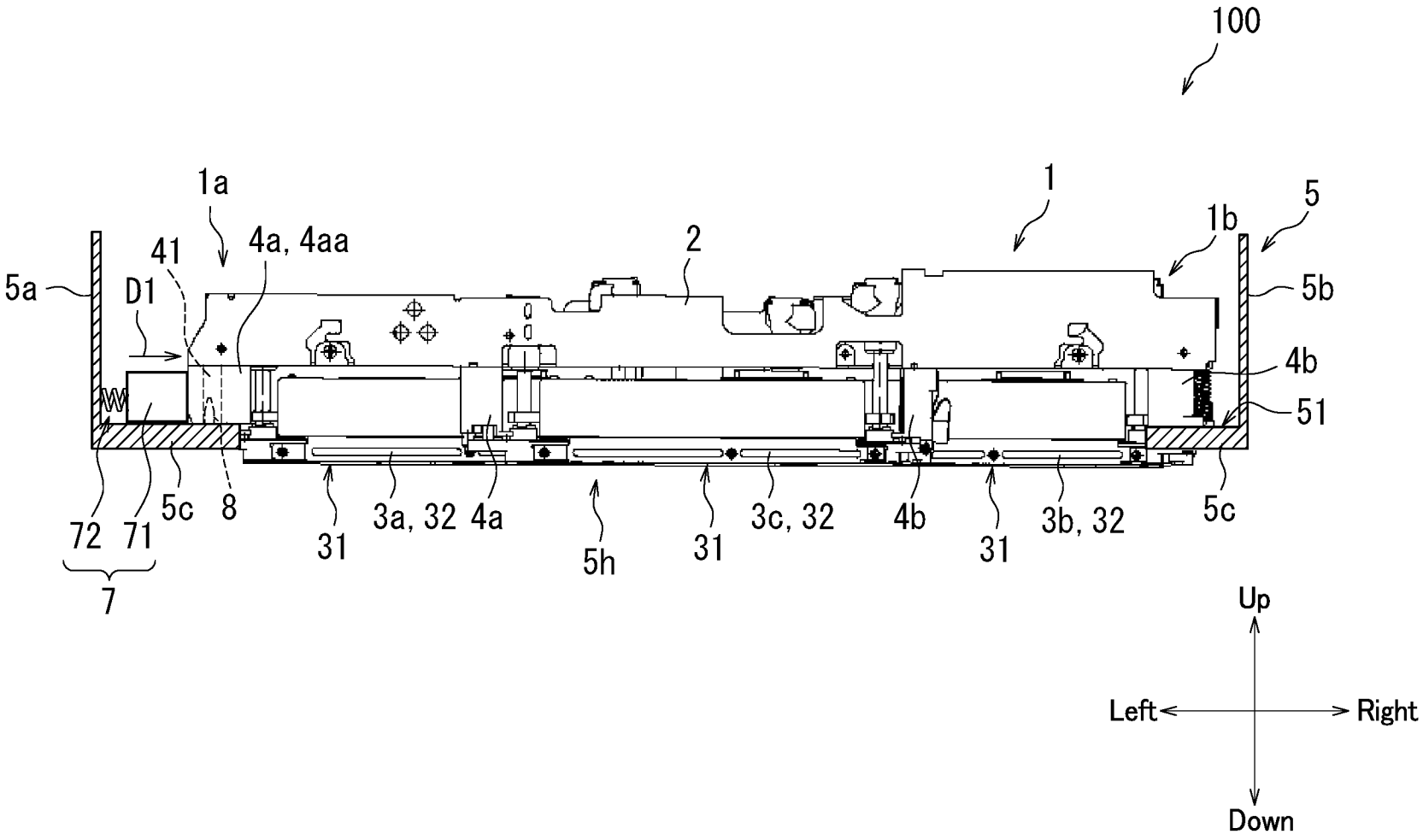
FIG. 5 illustrates the inkjet recording apparatus according to the embodiment of the present disclosure.

As illustrated in FIG. 4, the head assembly 1 includes an insertion hole 41. In the present embodiment, the insertion hole 41 is formed in a first coupling member 4*a* located at the side of the first end 1*a* of the head assembly 1. A positioning member 8 to be described with reference to FIG. 5 is to be inserted into the insertion hole 41. In the present embodiment, the insertion hole 41 is a through hole. Note that in the description below, the first coupling member 4*a* located at the side of the first end 1*a* of the head assembly 1 may be referred to as a "first coupling member 4*aa*".

The inkjet recording apparatus 100 according to the present embodiment will next be described with reference to FIG. 5. FIG. 5 illustrates the inkjet recording apparatus 100 according to the present embodiment. As illustrated in FIG. 5, the inkjet recording apparatus 100 includes the head assembly 1, an installation base 5, a regulation section 7, and the positioning member 8.

The head assembly 1 is installed in the installation base 5. The installation base 5 includes for example a frame body with an opening formed in an upper surface thereof. In this case, the installation base 5 houses the head assembly 1. The installation base 5 is supported by a body frame provided for the inkjet recording apparatus 100.

The installation base 5 includes a first side wall 5*a*, a second side wall 5*b*, and a bottom wall 5*c*. In the present embodiment, the first side wall 5*a* is a left side wall of the installation base 5 and the second side wall 5*b* is a right side wall thereof. The first side wall 5*a* is connected to a left end of the bottom wall 5*c* and extends upward from the bottom wall 5*c*. The second side wall 5*b* is connected to a right end of the bottom wall 5*c* and extends upward from the bottom wall 5*c*.

The bottom wall 5*c* includes an opening 5*h* and a loading surface 5*l*. The head assembly 1 is installed in the installation base 5 with part of a lower surface of the head assembly 1 mounted on the loading surface 5*l*. When the head assembly 1 is installed in the installation base 5, respective lower ends 32 (ends on each nozzle surface side) of the first to third recording heads 3*a* to 3*c* protrude from the opening 5*h*. The respective nozzle surfaces 31 of the first to third recording heads 3*a* to 3*c* are consequently positioned below the bottom wall 5*c* of the installation base 5.

The regulation section 7 is provided for the installation base 5 to regulate a position of the head assembly 1. Specifically, the regulation section 7 regulates the position of the head assembly 1 in a longitudinal direction thereof. The regulation section 7 is configured to press the head assembly 1 in a pressing direction D1 as illustrated in FIG. 5.

In the present embodiment, the pressing direction D1 is the right direction and is parallel or nearly parallel to the longitudinal direction of the head assembly 1. In other words, the pressing direction D1 is parallel or nearly parallel to a direction in which 3 recording heads 3 are arranged. The regulation section 7 is located at a side of a first end 1*a* of the head assembly 1 to press the head assembly 1 rightward. Specifically, the regulation section 7 presses a first coupling member 4*aa* in the pressing direction D1.

The positioning member 8 is provided for the installation base 5 and determines the position of the head assembly 1 installed in the installation base 5. Specifically, the positioning member 8 regulates the position of the head assembly 1 in the longitudinal direction. In the present embodiment, the positioning member 8 is a pin-shaped member and provided on the bottom wall 5*c* of the installation base 5. Specifically, the positioning member 8 protrudes upward from the loading surface 5*l*. The positioning member 8 is located at a side of the first end 1*a* of the head assembly 1 and inserted into an insertion hole 41 of the first coupling member 4*aa*. As a result, the position of the head assembly 1 in the longitudinal direction is determined.

Specifically, the insertion hole 41 is larger in dimension in the pressing direction D1 than the positioning member 8 as illustrated by dimension L1 of the insertion hole 41 and dimension L2 of the positioning member 8 which will be described with reference to FIG. 7. The regulation section 7 therefore presses the head assembly 1 in the pressing direction D1, so that a left inner side surface 411 of an inner wall forming the insertion hole 41 is pressed against the positioning member 8. Thus, the position of the head assembly 1 in the longitudinal direction is regulated and determined. Note that the dimension L2 of the positioning member 8 in the pressing direction D1 represents a diameter of the positioning member 8 in the present embodiment.

The inkjet recording apparatus 100 according to the present embodiment has been described above with reference to FIGS. 1 to 5. Returning to FIG. 5, in the embodiment, the dimension L1 of the insertion hole 41 in the pressing direction D1 is larger than the dimension L2 of the positioning member 8 in the pressing direction D1. This facilitates working of inserting the positioning member 8 into the insertion hole 41. It is accordingly possible to easily install the head assembly 1 in the installation base 5. In addition, when the positioning member 8 is inserted into the insertion hole 41, the regulation section 7 presses the head assembly 1 in the pressing direction D1, while the left inner side surface 411 of the insertion hole 41 is pressed against the positioning member 8. As a result, the position of the head assembly 1 in the longitudinal direction is determined. Thus, the head assembly 1 is positioned according to working of installing the head assembly 1 in the installation base 5. The configuration facilitates both working of determining the position of the head assembly 1 and working of installing the head assembly 1 in the installation base 5.

Next, the regulation section 7 in the present embodiment will further be described with reference to FIG. 5. As illustrated in FIG. 5, the regulation section 7 in the present embodiment includes a contact member 71 and an urging member 72. The contact member 71 is in contact with the head assembly 1. Specifically, the contact member 71 in the present embodiment is located at the side of the first end 1*a* of the head assembly 1 and in contact with a left side surface of the first coupling member 4*aa*. The urging member 72 urges the contact member 71 in the pressing direction D1. The head assembly 1 is consequently pressed in the pressing direction D1.

Specifically, the contact member 71 is mounted on an upper surface of the bottom wall 5*c* of the installation base 5 and allowed to slide thereon. The urging member 72 has one end connected to the first side wall 5*a* and a different end connected to the contact member 71. For example, the one end of the urging member 72 is fixed to the first side wall 5*a* and the different end of the urging member 72 is fixed to the contact member 71. The urging member 72 is for example a spring member.

Figure 6:
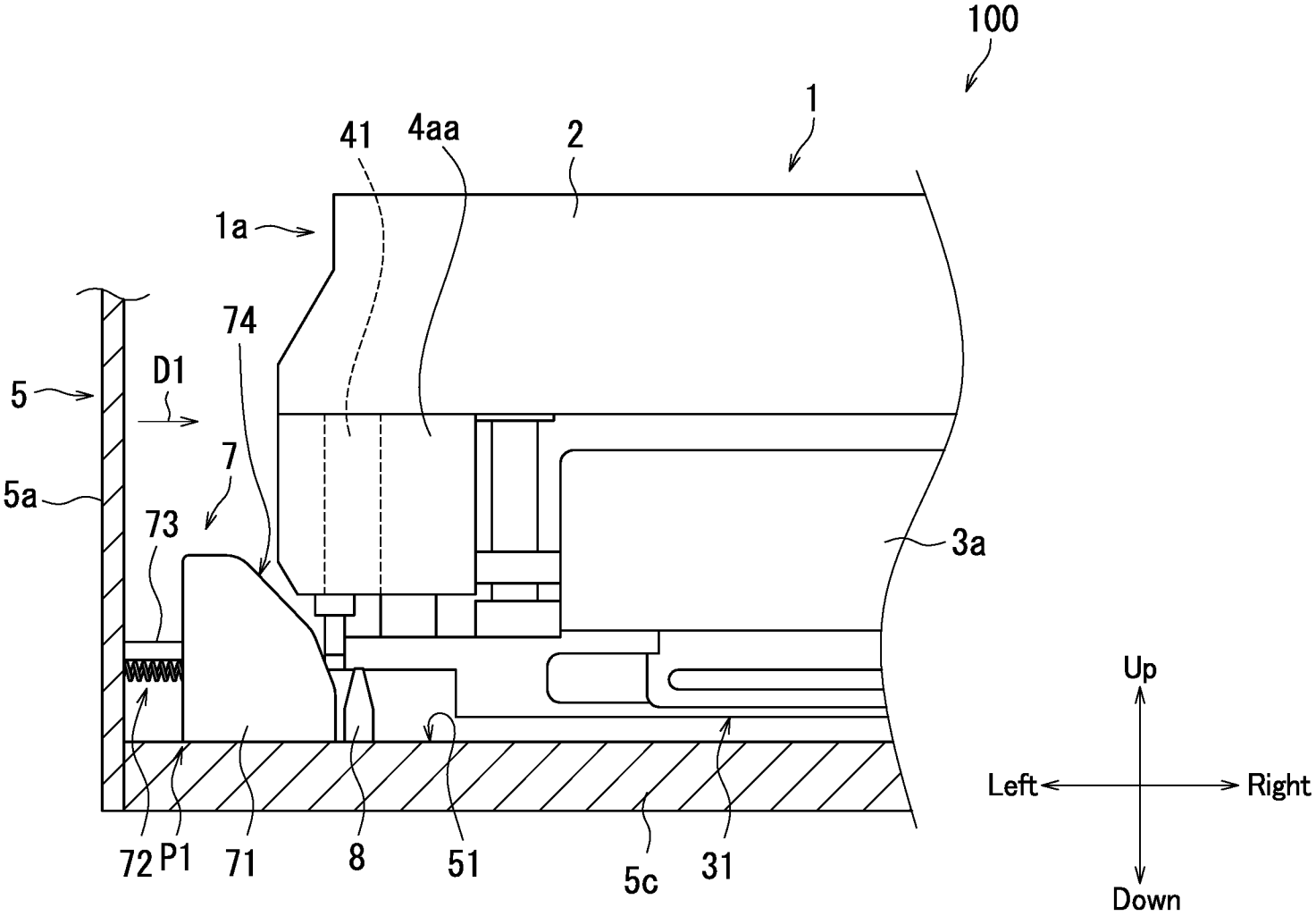
FIG. 6 is an enlarged view of part of the inkjet recording apparatus according to the embodiment of the present disclosure.

Next, the inkjet recording apparatus 100 according to the present embodiment will further be described with reference to FIGS. 6 and 7. FIG. 6 is an enlarged view of part of the inkjet recording apparatus 100. Specifically, FIG. 6 is an enlarged view of part, on the side of the first end 1*a* of the inkjet recording apparatus 100. FIG. 6 illustrates a state before the head assembly 1 is installed in the installation base 5.

As illustrated in FIG. 6, in the state before the head assembly 1 is installed in the installation base 5, the contact member 71 receiving urging force of the urging member 72 is in a first position P1. A worker causes the head assembly 1 to come into contact with the contact member 71 when installing the head assembly 1 in the installation base 5. Specifically, the worker causes the first coupling member 4*aa* to come into contact with the contact member 71. After causing the first coupling member 4*aa* to come into contact with the contact member 71, the worker presses the head assembly 1 downward against the urging force of the urging member 72, thereby moving the contact member 71 toward the first side wall 5*a*. In other words, the contact member 71 moves in a direction opposite to the pressing direction D1.

Figure 7:
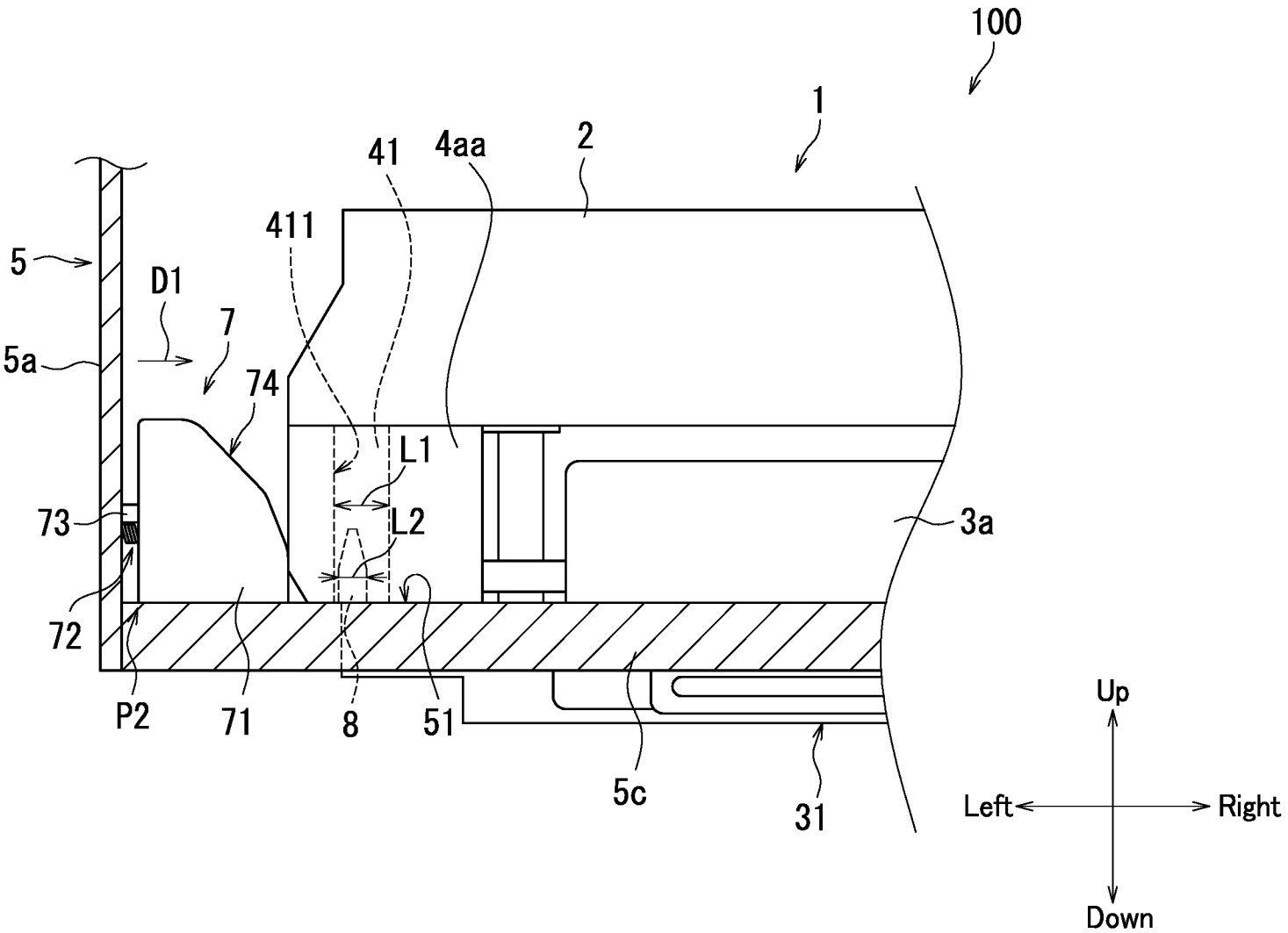
FIG. 7 is an enlarged view of part of the inkjet recording apparatus according to the embodiment of the present disclosure.

FIG. 7 is an enlarged view of part of the inkjet recording apparatus 100. Specifically, FIG. 7 is an enlarged view of part, on the side of the first end 1*a*, of the head assembly 1. In addition, FIG. 7 illustrates the head assembly 1 installed in the installation base 5.

As illustrated in FIG. 7, when the head assembly 1 is installed in the installation base 5, the positioning member 8 is inserted into the insertion hole 41 of the first coupling member 4*aa*. In addition, the contact member 71 is moved to a second position P2 from the first position P1 described with reference to FIG. 7. The second position P2 is a position nearer to the first side wall 5*a* than the first position P1. The urging member 72 urges the contact member 71, which is placed in the second position P2, in a direction from the second position P2 toward the first position P1. That is, the urging member 72 urges the contact member 71 in the pressing direction D1. Thus, the first coupling member 4*aa* is pressed in the pressing direction D1 by the contact member 71 receiving the urging force of the urging member 72. In other words, the head assembly 1 is pressed in the pressing direction D1 by the contact member 71 receiving the urging force of the urging member 72. Since the dimension L1 of the insertion hole 41 in the pressing direction D1 is larger than the dimension L2 of the positioning member 8 in the pressing direction D1, the head assembly 1 is pressed in the pressing direction D1, while the left inner side surface 411 of the insertion hole 41 is pressed against the positioning member 8. The insertion hole 41 may be an elongated hole that is elongated in the longitudinal direction of the head assembly 1 or a longitudinal direction of a base member 2.

As described above with reference to FIGS. 6 and 7, just before the head assembly 1 is installed in the installation base 5 (see FIG. 6), the contact member 71 is in the position (first position P1) where the contact member 71 is in contact with part (first coupling member 4*aa*), different from the nozzle surface 31, of the head assembly 1. Thus, when the head assembly 1 is installed in the installation base 5, the contact member 71 first comes into contact with the part (first coupling member 4*aa*), different from the nozzle surface 31, of the head assembly 1. This makes it difficult that the nozzle surface 31 comes into contact with components constituting the installation base 5, thereby enabling a reduction in the possibility that nozzle orifices of the nozzle surface 31 will be damaged.

Next, the regulation section 7 in the present embodiment will further be described with reference to FIGS. 6 and 7. As illustrated in FIGS. 6 and 7, the regulation section 7 further includes a guide member 73. The guide member 73 is a rod-shaped member that extends in the pressing direction D1. Specifically, the guide member 73 has one end fixed to the first side wall 5*a* and extends from the first side wall 5*a* in the pressing direction D1. An insertion hole is formed in the contact member 71 and the guide member 73 is inserted into the insertion hole. The insertion hole of the contact member 71 includes an opening formed in a left side surface of the contact member 71 and extends from the left side surface of the contact member 71 in the pressing direction D1 (right direction). The contact member 71 is therefore guided by the guide member 73 in both the pressing direction D1 and the direction opposite to the pressing direction D1.

As illustrated in FIGS. 6 and 7, the contact member 71 includes a guide surface 74. The guide surface 74 guides the head assembly 1 in a position where the positioning member 8 is inserted into the insertion hole 41 when the head assembly 1 is installed in the installation base 5. Specifically, the guide surface 74 includes one or more downward slopes which are inclined rightward from the side of the first side wall 5*a* so as to approach the loading surface 5*l*. In the present embodiment, the guide surface 74 includes one or more downward slopes which are inclined downward toward the right. Specifically, the guide surface 74 including one or more downward slopes is inclined toward the positioning member 8. The guide surface 74 accordingly guides the head assembly 1 to the position where the positioning member 8 is inserted into the insertion hole 41 as a result of the head assembly 1 being pressed downward with the first coupling member 4*aa* being in contact with the guide surface 74 when the head assembly 1 is installed in the installation base 5. Thus, by moving the head assembly 1 downward while being guided by the guide surface 74, the positioning member 8 is inserted into the insertion hole 41. It is therefore possible to easily install the head assembly 1 in the installation base 5. In addition, the guide surface 74 guiding the head assembly 1 to the position where the positioning member 8 is inserted into the insertion hole 41 makes it difficult that the nozzle surface 31 comes into contact with the components constituting the installation base 5.

Figure 8:
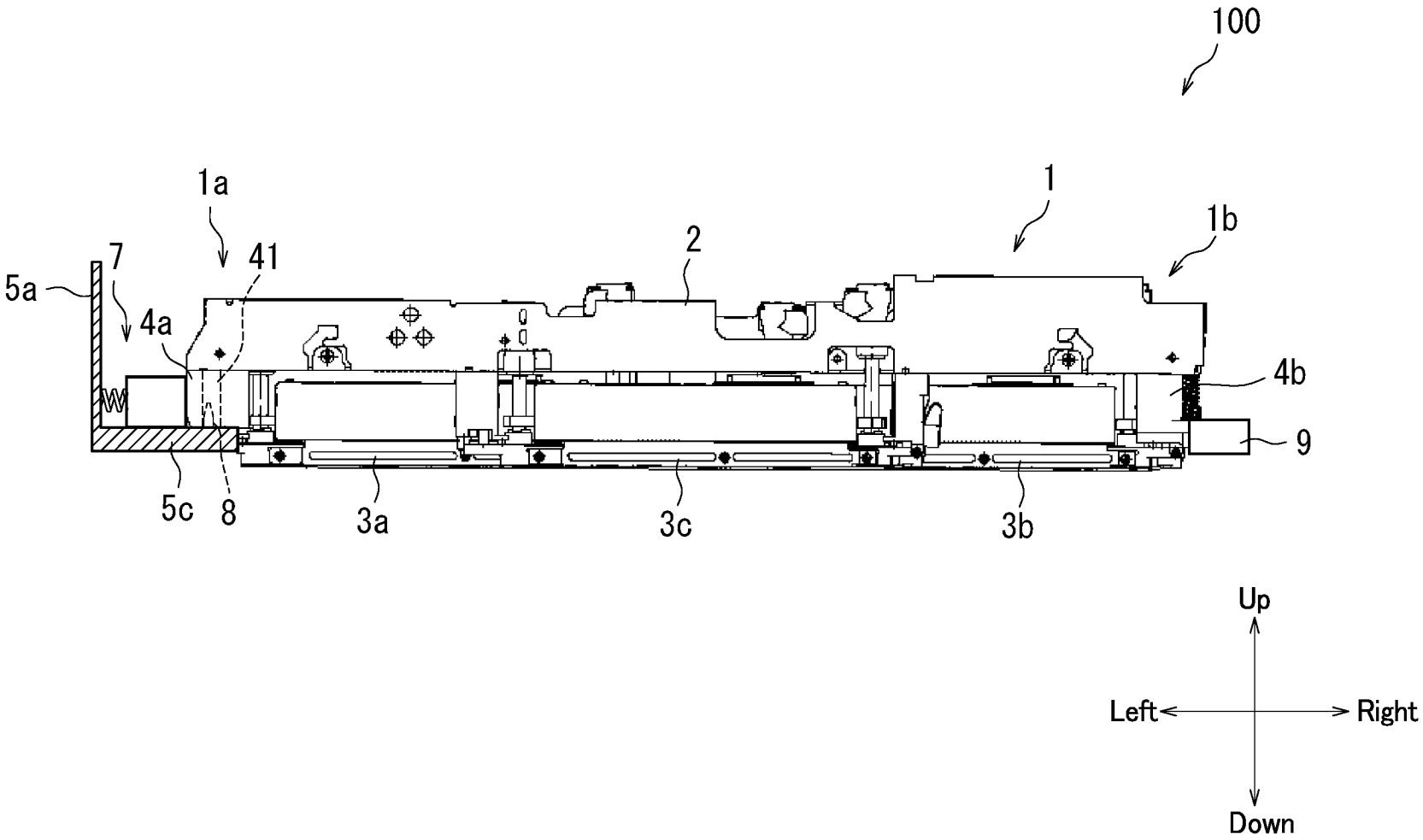
FIG. 8 illustrates the inkjet recording apparatus according to the embodiment of the present disclosure.
Figure 9:
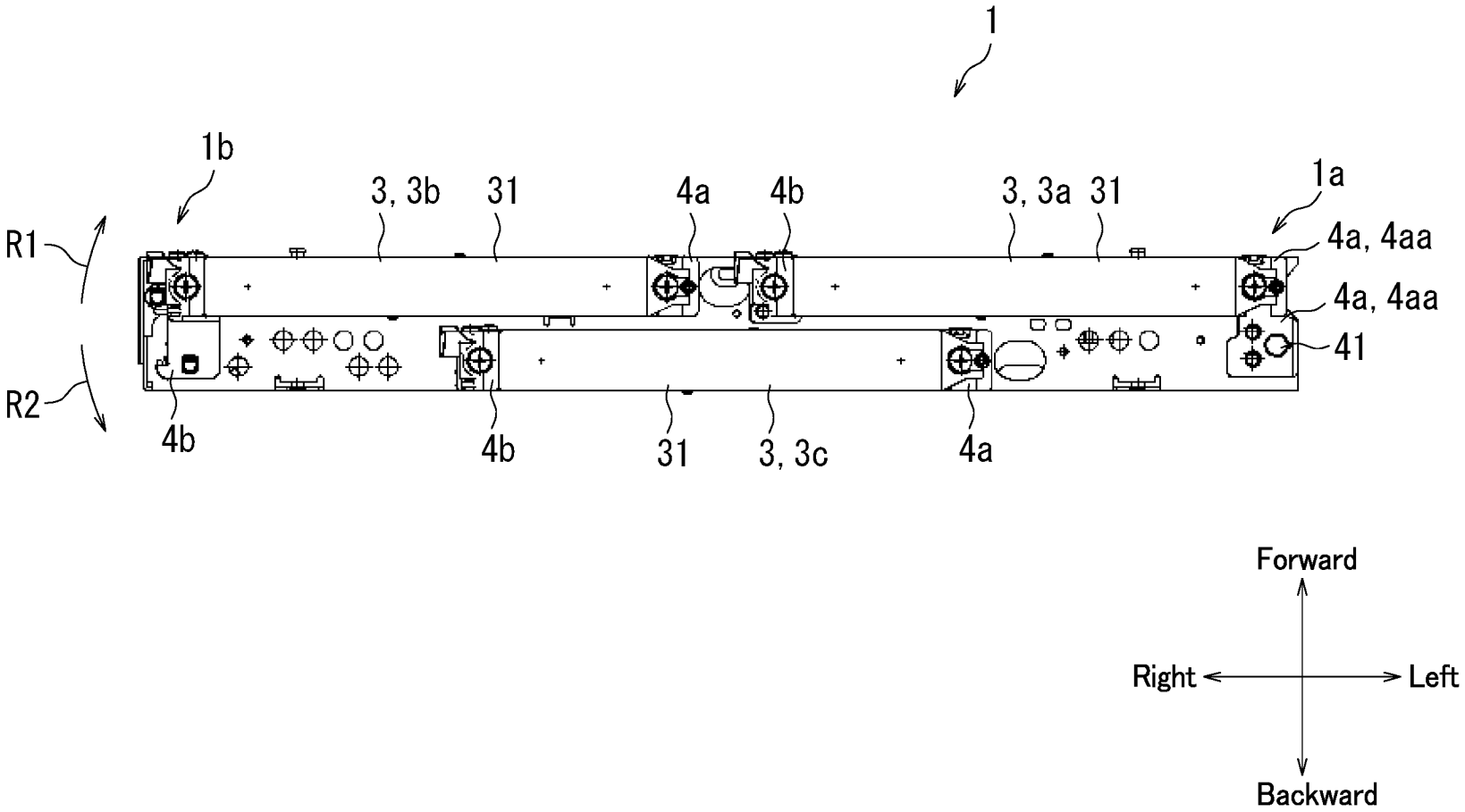
FIG. 9 is a bottom view of the head assembly in the embodiment of the present disclosure.

Next, the inkjet recording apparatus 100 according to the present embodiment will further be described with reference to FIGS. 8 and 9. FIG. 8 illustrates the inkjet recording apparatus 100 according to the present embodiment. Note that a part of the bottom wall 5*c* and the second side wall 5*b* described with reference to FIG. 5 are omitted in FIG. 8 in order to simplify the drawing. FIG. 9 is a bottom view of the head assembly 1 in the present embodiment. Specifically, FIG. 9 illustrates a rotation direction R1 and a rotation direction R2 of the head assembly 1. The rotation direction R2 is a rotation direction opposite to the rotation direction R1.

As illustrated in FIG. 8, the inkjet recording apparatus 100 further includes an angle adjustment mechanism 9. The angle adjustment mechanism 9 rotates the head assembly 1 about the positioning member 8 as a rotation center. That is, in the present embodiment, the positioning member 8 functions as a rotating shaft of the head assembly 1. In other words, the positioning member 8 functions as a rotating shaft member. The angle adjustment mechanism 9 is installed in the installation base 5 described with reference to FIG. 4. Specifically, the angle adjustment mechanism 9 is located at a side of a second end 1*b* of the head assembly 1.

Specifically, the angle adjustment mechanism 9 (FIG. 8) rotates the head assembly 1 about the positioning member 8 (insertion hole 41) as the rotation center in the rotation direction R1 or the rotation direction R2 as illustrated in FIG. 9. The angle of the head assembly 1 relative to the installation base 5 is accordingly adjusted. In the present embodiment, the angle of the head assembly 1 relative to the left-right direction is adjusted.

The inkjet recording apparatus 100 according to the present embodiment has been described above with reference to FIGS. 8 and 9. The present embodiment enables the worker to adjust the angle of the head assembly 1 by operating the angle adjustment mechanism 9. Specifically, the inkjet recording apparatus 100 includes four head assemblies 1 (first head assembly 11, second head assembly 12, third head assembly 13, and fourth head assembly) to be described with reference to FIG. 13. The inkjet recording apparatus 100 includes respective angle adjustment mechanisms 9 provided for the four head assemblies 1. The present embodiment enables the worker to arrange the four head assemblies 1 in parallel by adjusting respective angles of the four head assemblies 1. The angle adjustment of the head assemblies 1 is performed after the head assemblies 1 are installed in the installation base 5.

Figure 10:
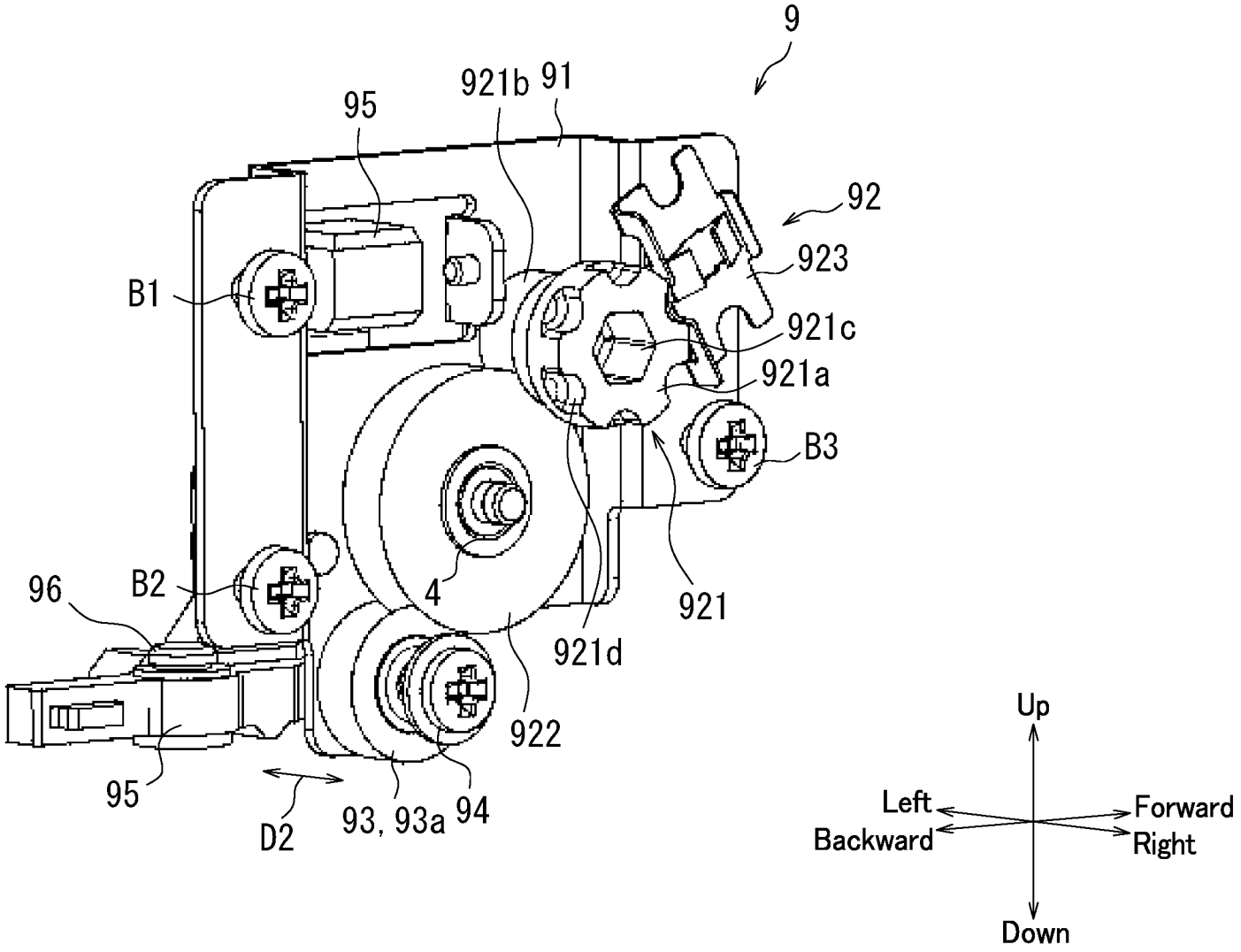
FIG. 10 is a perspective view of an angle adjustment mechanism in the embodiment of the present disclosure.

Next, the angle adjustment mechanisms 9 in the present embodiment will further be described with reference to FIGS. 10 to 12. FIG. 10 is a perspective view of one angle adjustment mechanism 9 in the present embodiment. Specifically, FIG. 10 illustrates the angle adjustment mechanism 9 as seen diagonally from back right.

As illustrated in FIG. 10, the angle adjustment mechanism 9 includes an attachment plate 91, a coupling mechanism 92, a pressing member 93, a rotating shaft member 94, an angle adjustment member 95, and a rotating shaft member 96. The angle adjustment mechanism 9 further includes three fastening members B1 to B3.

The coupling mechanism 92 and the pressing member 93 are attached to the attachment plate 91. The attachment plate 91 is fixed to the second side wall 5*b* described with reference to FIG. 5 with the three fastening members B1 to B3.

The rotating shaft member 94 supports the pressing member 93 in a movable manner in a movement direction D2 illustrated in FIG. 10. The coupling mechanism 92 is coupled to the pressing member 93. The coupling mechanism 92 is operated by the worker. The coupling mechanism 92 moves the pressing member 93 in the movement direction D2 according to the worker operation. The angle adjustment member 95 rotates about the rotating shaft member 96 as a rotation center according to movement of the pressing member 93 in the movement direction D2 to be described with reference to FIG. 11.

In the present embodiment, the coupling mechanism 92 includes an operation member 921 that is operable by the worker. The coupling mechanism 92 moves the pressing member 93 in the movement direction D2 according to the worker operation of the operation member 921. Specifically, the coupling mechanism 92 in the present embodiment includes an idler gear 922 in addition to the operation member 921.

The operation member 921 is attached to the attachment plate 91 in a rotatable manner. The operation member 921 includes an operation part 921*a*, a gear part 921*b*, and an operation hole 921*c*. This configuration enables the worker to rotate the operation member 921 with for example a hex wrench fit into the operation hole 921*c*. The gear part 921*b* has a tooth part. The tooth part is located on a peripheral surface of the gear part 921*b*. Specifically, the tooth part of the gear part 921*b* includes teeth arranged around the gear part 921*b* in a peripheral direction thereof.

The pressing member 93 is supported by the rotating shaft member 94 in a rotatable manner. In other words, the pressing member 93 is rotatable about the rotating shaft member 94 as a rotation center. The pressing member 93 includes a gear part 93*a*. The gear part 93*a* has a tooth part. The tooth part is located on a peripheral surface of the gear part 93*a*. Specifically, the tooth part of the gear part 93*a* includes teeth arranged around the gear part 93*a* in a peripheral direction thereof.

The idler gear 922 is attached to the attachment plate 91 in a rotatable manner. The idler gear 922 has a tooth part. The tooth part is located on a peripheral surface of the idler gear 922. Specifically, the tooth part of the idler gear 922 includes teeth arranged around the idler gear 922 in a peripheral direction thereof. The idler gear 922 is positioned so that the tooth part of the idler gear 922 engages with the tooth part of the operation member 921 (gear part 921*b*) and tooth part of the pressing member 93 (gear part 93*a*). This enables the pressing member 93 to rotate according to rotation of the operation member 921.

The pressing member 93 includes a through hole. The through hole is a tapped hole and the rotating shaft member 94 is inserted into the through hole. Specifically, a thread groove is formed in a surface of a shaft of the rotating shaft member 94 and the shaft of the rotating shaft member 94 is screwed into the through hole of the pressing member 93. This enables the pressing member 93 to move in the movement direction D2 according to rotation of the idler gear 922.

In the present embodiment, the coupling mechanism 92 further includes a click part 923. The operation member 921 includes recesses 921*d*. The recesses 921*d* are located on a peripheral surface of the operation part 921*a*. Specifically, the recesses 921*d* are arranged around the operation part 921*a* in a peripheral direction thereof.

The click part 923 sequentially engages with each of the recesses 921*d* of the operation member 921 according to the rotation of the operation member 921. This enables the worker to obtain clicking sensation from the click part 923 by operating the operation member 921. Thus, the worker can recognize a change in the angle of the head assembly 1 based on the clicking sensation during the angle adjustment of the head assembly 1. The click part 923 is produced by processing for example a leaf spring.

Next, the angle adjustment mechanism 9 and the head assembly 1 will further be described with reference to FIG. 11. FIG. 11 is a bottom view depicting the angle adjustment mechanism 9 and a second coupling member 4*b* in the present embodiment. Specifically, FIG. 11 illustrates the second coupling member 4*b* located at the side of the second end 1*b* of the head assembly 1. In the description below, the second coupling member 4*b* located at the side of the second end 1*b* of the head assembly 1 may be referred to as a "second coupling member 4*bb*".

Figure 11:
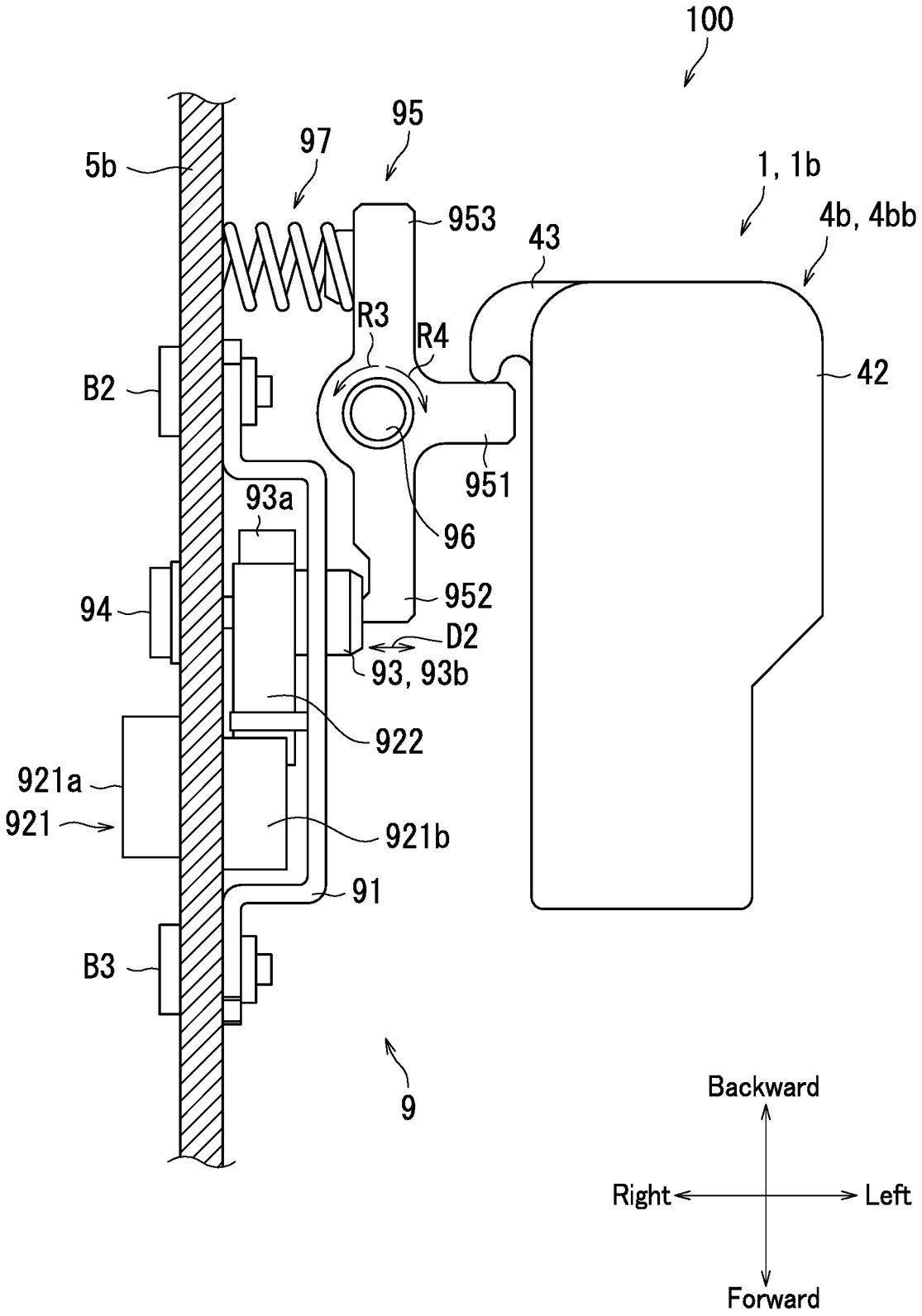
FIG. 11 is a bottom view depicting the angle adjustment mechanism and a second coupling member in the embodiment of the present disclosure.

As illustrated in FIG. 11, the angle adjustment member 95 is placed inside the second side wall 5*b*. The angle adjustment member 95 is rotatable about the rotating shaft member 96 as the rotation center. Specifically, the angle adjustment member 95 is rotatable in a rotation direction R3 and a rotation direction R4 illustrated in FIG. 11. The rotation direction R4 is a rotation direction opposite to the rotation direction R3.

The angle adjustment member 95 includes a first engagement part 951 that engages with the head assembly 1. In the present embodiment, the first engagement part 951 is a protrusion piece that protrudes in a direction perpendicular to a direction in which the rotating shaft member 96 extends. Specifically, the first engagement part 951 protrudes in a radial direction from a center part (rotating shaft member 96) of the angle adjustment member 95. That is, the first engagement part 951 extends toward a lower end 42 of the second coupling member 4*bb*.

The head assembly 1 includes a head engagement part 43 that engages with the first engagement part 951. In the present embodiment, the head engagement part 43 is a protrusion piece that is in contact with the first engagement part 951 and that protrudes from the lower end 42 of the second coupling member 4*bb*. In other words, the lower end 42 of the second coupling member 4*bb* includes the head engagement part 43.

The angle adjustment member 95 is positioned so that the first engagement part 951 pushes the head engagement part 43 according to rotation of the angle adjustment member 95 about the rotating shaft member 96 as the rotation center in the rotation direction R3. The head assembly 1 rotates about the positioning member 8 (insertion hole 41) as the rotation center in the rotation direction R2 according to the first engagement part 951 pushing the head engagement part 43 as described with reference to FIGS. 8 and 9.

As illustrated in FIG. 11, the angle adjustment member 95 further includes a second engagement part 952 that engages with the pressing member 93. In the present embodiment, the second engagement part 952 is a protrusion piece that protrudes in a direction perpendicular to a direction in which the rotating shaft member 96 extends. Specifically, the second engagement part 952 protrudes in a radial direction from the center part (rotating shaft member 96) of the angle adjustment member 95. Specifically, the second engagement part 952 protrudes in a direction different from a direction in which the first engagement part 951 protrudes.

The pressing member 93 includes a contact part 93*b*. The contact part 93*b* is in contact with the angle adjustment member 95. Specifically, the contact part 93*b* is in contact with the second engagement part 952. The contact part 93*b* pushes the second engagement part 952 according to movement of the pressing member 93 in the movement direction D2, thereby rotating the angle adjustment member 95 in the rotation direction R3. The head assembly 1 accordingly rotates about the positioning member 8 (insertion hole 41) as the rotation center in the rotation direction R2 as described with reference to FIGS. 8 and 9. In other words, the head assembly 1 rotates in the rotation direction R2 according to the worker operation of the operation member 921. This enables the worker to adjust the angle of the head assembly 1 by operating the operation member 921.

Specifically, the contact part 93*b* penetrates the attachment plate 91. A protrusion length of the contact part 93*b* from the attachment plate 91 varies according to movement of the pressing member 93 in the movement direction D2. Here, the protrusion length is length of the contact part 93*b* protruding from the attachment plate 91 toward the second engagement part 952. This enables the worker to vary the protrusion length of the contact part 93*b* from the attachment plate 91 by rotating the operation member 921. When the protrusion length of the contact part 93*b* from the attachment plate 91 is increased, the angle adjustment member 95 rotates in the rotation direction R3 according to the contact part 93*b* pushing the second engagement part 952. The head assembly 1 accordingly rotates about the positioning member 8 as the rotation center in the rotation direction R2.

As illustrated in FIG. 11, the angle adjustment mechanism 9 includes an urging member 97. The urging member 97 urges the angle adjustment member 95 so that the angle adjustment member 95 rotates in the rotation direction R4. The urging member 97 is for example a spring member.

Specifically, the angle adjustment member 95 includes a third engagement part 953 that engages with the urging member 97. In the present embodiment, the third engagement part 953 is a protrusion piece that extends in a direction perpendicular to a direction in which the rotating shaft member 96 extends. Specifically, the third engagement part 953 protrudes in a radial direction from the center part (rotating shaft member 96) of the angle adjustment member 95. Specifically, the third engagement part 953 protrudes in a direction different from the respective directions in which the first and second engagement parts 951 and 952 protrude. The urging member 97 urges the third engagement part 953 so that the angle adjustment member 95 rotates in the rotation direction R4.

When the length of the contact part 93*b* protruding from the attachment plate 91 is decreased according to the worker operation of the operation member 921, the angle adjustment member 95 receiving urging force of the urging member 97 rotates in the rotation direction R4 following movement of the pressing member 93. The head assembly 1 accordingly rotates about the positioning member 8 (insertion hole 41) as the rotation center in the rotation direction R1 as described with reference to FIGS. 8 and 9.

Next, the operation member 921 will further be described with reference to FIG. 11. As illustrated in FIG. 11, the operation member 921 is placed outside the second side wall 5*b*. This enables the worker to easily adjust the angle of the head assembly 1 installed in the installation base 5.

Next, the angle adjustment mechanism 9 will further be described with reference to FIG. 12. FIG. 12 is a perspective view of the angle adjustment mechanism 9 in the present embodiment. Specifically, FIG. 12 illustrates the angle adjustment mechanism 9 as seen diagonally from above front left.

Figure 12:
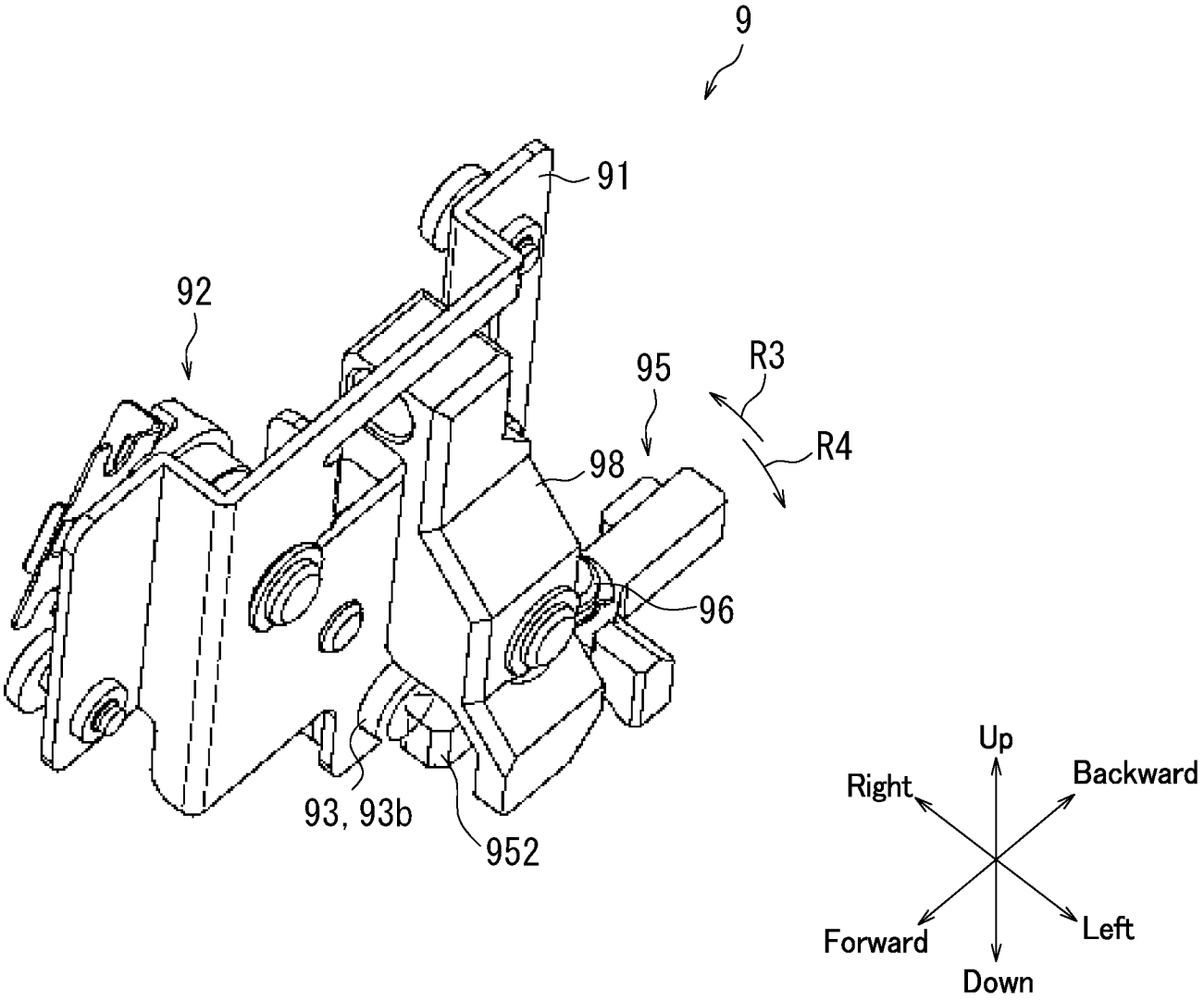
FIG. 12 is a perspective view of the angle adjustment mechanism in the embodiment of the present disclosure.

As illustrated in FIG. 12, the angle adjustment mechanism 9 further includes a regulation member 98. The regulation member 98 regulates rotation of the angle adjustment member 95. The regulation member 98 in the present embodiment regulates the rotation of the angle adjustment member 95 in the rotation direction R3. Specifically, the angle adjustment member 95 rotates in the rotation direction R3 according to an increase in the length of the contact part 93*b* protruding from the attachment plate 91 as described with reference to FIG. 11. The regulation member 98 therefore regulates the rotation of the angle adjustment member 95 according to the increase in the length of the contact part 93*b* protruding from the attachment plate 91.

The regulation member 98 regulating the rotation of the angle adjustment member 95 in the rotation direction R3 makes it difficult that the head assembly 1 collides with the components constituting the installation base 5 during the angle adjustment of the head assembly 1. It is accordingly possible to reduce failure of the head assembly 1 due to the head assembly 1 colliding with the components constituting the installation base 5. For example, the nozzle surface 31 of the recording head 3 is less likely to collide with the components constituting the installation base 5. It is accordingly possible to reduce damage of the nozzle orifices due to the nozzle surface 31 of the recording head 3 colliding with the components constituting the installation base 5.

Note that the rotation of the angle adjustment member 95 in the rotation direction R4 is regulated by the second side wall 5*b* or the attachment plate 91 as illustrated in FIG. 11. Specifically, the movement of the pressing member 93 is regulated by the second side wall 5*b*. Alternatively, the rotation of the second engagement part 952 is regulated by the attachment plate 91.

Figure 13:
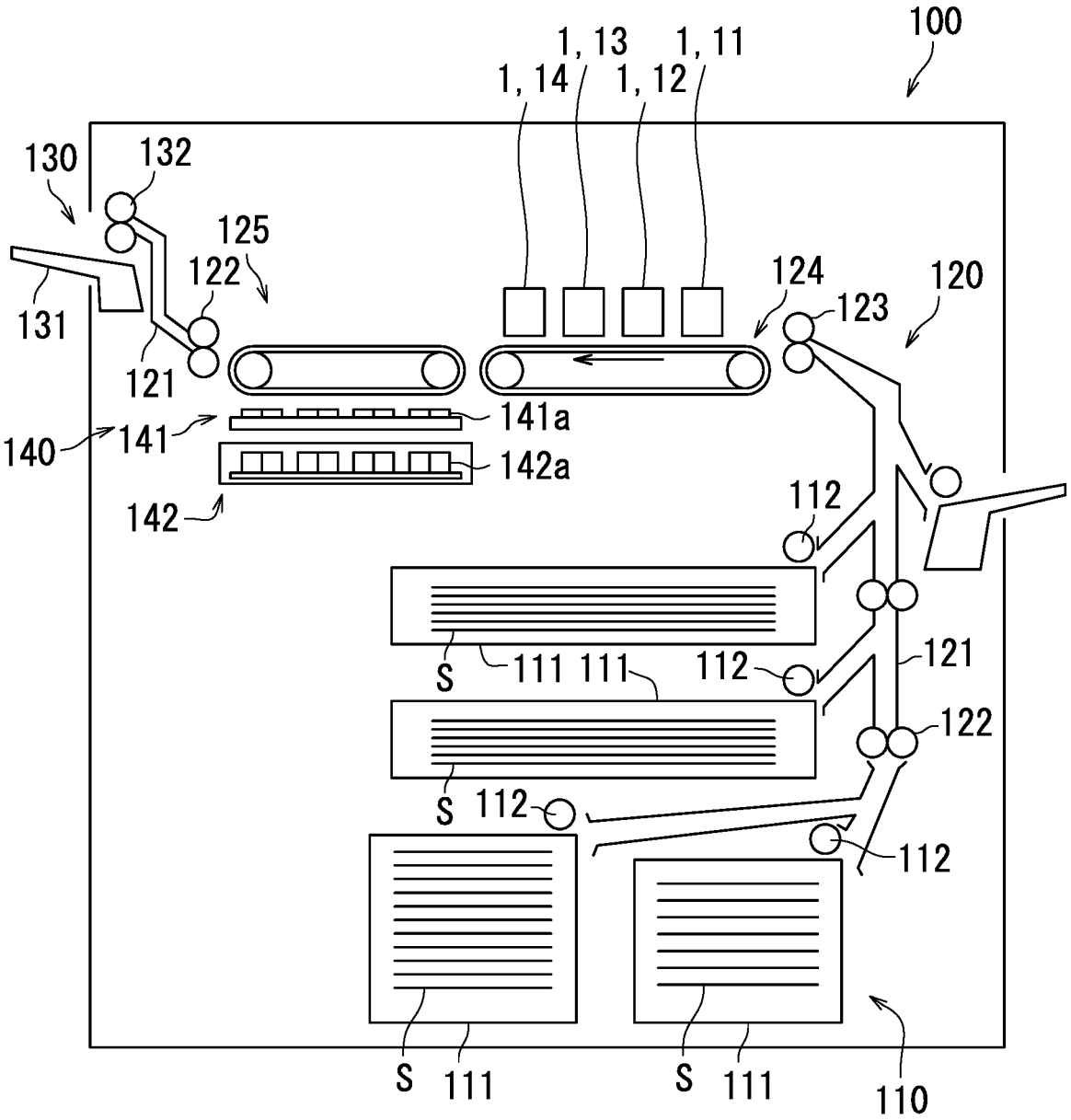
FIG. 13 illustrates the inkjet recording apparatus according to the embodiment of the present disclosure.

Next, the inkjet recording apparatus 100 according to the present embodiment will further be described with reference to FIG. 13. FIG. 13 illustrates a configuration of the inkjet recording apparatus 100 according to the present embodiment.

As illustrated in FIG. 13, the inkjet recording apparatus 100 includes a feeding section 110, a sheet conveyance section 120, an ejection section 130, and a maintenance unit 140. As stated above, the inkjet recording apparatus 100 includes the first head assembly 11, the second head assembly 12, the third head assembly 13, and the fourth head assembly 14.

The feeding section 110 feeds a sheet S to the sheet conveyance section 120. The feeding section 110 in the present embodiment includes housing cassettes 111 and feeding rollers 112. Each of the housing cassettes 111 houses therein at least one sheer S. Each of the feeding rollers 112 feeds a sheet S from a corresponding housing cassette 111 to the sheet conveyance section 120. Note that the sheet S is an example of a recording medium.

The sheet conveyance section 120 conveys a sheet S from each of the housing cassettes 111 to the ejection section 130. Specifically, the sheet conveyance section 120 includes conveyance guides 121, conveyance roller pairs 122, and a registration roller pair 123. The conveyance guides 121 constitute a conveyance path of the sheet S. The conveyance roller pairs 122 convey the sheet S along the conveyance path. The registration roller pair 123 adjusts conveyance timing of the sheet S to an area facing the first to fourth head assemblies 11 to 14.

The sheet conveyance section 120 in the present embodiment includes a first conveyance unit 124 and a second conveyance unit 125. The first conveyance unit 124 faces the first to fourth head assemblies 11 to 14. The first conveyance unit 124 conveys the sheet S in an area directly under the first to fourth head assemblies 11 to 14. The second conveyance unit 125 conveys the sheet S sent out from the first conveyance unit 124 toward the ejection section 130.

The three recording heads 3 provided for each of the first to fourth head assemblies 11 to 14 eject ink to the sheet S being conveyed by the first conveyance unit 124. Specifically, the first to fourth head assemblies 11 to 14 eject ink of different colors. For example, the three recording heads 3 of the first head assembly 11 eject black ink. The three recording heads 3 of the second head assembly 12 eject cyan ink. The three recording heads 3 of the third head assembly 13 eject magenta ink. The three recording heads 3 of the fourth head assembly 14 eject yellow ink.

The ejection section 130 ejects the sheet S to an outside of the inkjet recording apparatus 100. The ejection section 130 in the present embodiment includes an exit tray 131 and an ejection roller pair 132. The ejection roller pair 132 ejects the sheet S onto the exit tray 131.

The maintenance unit 140 performs maintenance of the three recording heads 3 for each of the first to fourth head assemblies 11 to 14. The maintenance unit 140 is placed below the second conveyance unit 125 when an image is recorded on the sheet S. and is moved to a location directly below the first to fourth head assemblies 11 to 14 during maintenance of the recording heads 3. Note that the first conveyance unit 124 is placed in a retraction position thereof during the maintenance of the recording heads 3. The retraction position is a position where the first conveyance unit 124 is prevented from colliding with the maintenance unit 140.

The maintenance unit 140 in the present embodiment includes a cap section 141 and a cleaning section 142. As described with reference to FIG. 3, each recording head 3 includes its own nozzle surface 31. The cap section 141 includes 12 capping members 141*a*. Each nozzle surface 31 of the three recording heads 3 for each head assembly 1 is capped with a corresponding one of the capping members 141*a* of the 12 capping members 141*a*. Thus, the 12 capping members 141*a* provide an environment where ink is less likely to dry.

The cleaning section 142 cleans the respective nozzle surfaces 31 of the recording heads 3. Specifically, the cleaning section 142 includes 12 wiper blades 142*a*. Material examples of each wiper blade 142*a* include resin. Each wiper blade 142*a* is a cleaning member for cleaning a corresponding one of the nozzle surfaces 31.

The cleaning section 142 moves the wiper blades 142*a* in the longitudinal direction of the recording heads 3 described with reference to FIG. 4 with the wiper blades 142*a* being in contact with respective lower surfaces of the recording heads 3. Thus, the nozzle surfaces 31 are cleaned as a result of the nozzle surfaces 31 being wiped off by the wiper blades 142*a*. Specifically, ink adhering to each nozzle surface 31 is wiped off by a corresponding one of the wiper blades 142*a*.

The embodiment of the present disclosure has been described above with reference to FIGS. 1 to 13. However, the present disclosure is not limited to the above embodiment and may be implemented in various manners within a scope not departing from the gist of the present disclosure. The components disclosed in the above embodiment can be changed as appropriate. The drawings schematically illustrate main elements of configuration to facilitate understanding thereof. Aspects of the elements of configuration illustrated in the drawings, such as thickness, length, number, and interval, may differ in practice for the sake of convenience for drawing preparation. Furthermore, aspects of the elements of configuration illustrated in the above embodiment are examples and are not particularly limited. The elements of configuration may be variously altered within a scope not substantially departing from the effects of the present disclosure.

For example, although the respective angle adjustment mechanisms 9 are provided for the first to fourth head assemblies 11 to 14 as described with reference to FIGS. 8 and 10 to 12, the present disclosure is not limited thereto. For example, the inkjet recording apparatus 100 may have a configuration in which no angle adjustment mechanism 9 is provided for the first head assembly 11.

Although the inkjet recording apparatus 100 includes the four head assemblies 1 as described with reference to FIG. 13, the number of head assemblies 1 provided for the inkjet recording apparatus 100 may be one, two, three, or five or more.

Although the head assembly 1 includes three recording heads 3 as described with reference to FIGS. 2 to 5, 8 and 9, the number of recording heads 3 provided for the head assembly 1 may be one, two, or four or more.

Although the coupling mechanism 92 includes the operation member 921 and the idler gear 922 as described with reference to FIGS. 10 and 11, the coupling mechanism 92 may include only the operation member 921. That is, the coupling mechanism 92 may have a configuration in which the tooth part of the operation member 921 (gear part 921*b*) engages with the tooth part of the pressing member 93 (gear part 93*a*). Alternatively, the coupling mechanism 92 may include idler gears 922.

What is claimed is:

1. An inkjet recording apparatus comprising:

a head assembly including a recording head configured to eject ink;

an installation base in which the head assembly is installed;

a positioning member that is provided for the installation base and determines a position of the head assembly; and a regulation member that is provided for the installation base and regulates the position of the head assembly, wherein the regulation member is configured to press the head assembly in a pressing direction, the positioning member protrudes in a direction that intersects with the pressing direction, the head assembly includes an insertion hole into which the positioning member is inserted, and the insertion hole is larger in dimension in the pressing direction than the positioning member.

2. The inkjet recording apparatus according to claim 1, wherein the regulation section includes:

a contact member that is in contact with the head assembly; and an urging member that urges the contact member in the pressing direction.

3. The inkjet recording apparatus according to claim 2, wherein the contact member includes a guide surface that guides the head assembly to a position where the positioning member is inserted into the insertion hole when the head assembly is installed in the installation base.

4. The inkjet recording apparatus according to claim 2, wherein the head assembly includes:

a base member; and a coupling member that couples the recording head to the base member, the regulation section has a configuration in which the contact member is in a first position in a state before the head assembly is installed in the installation base, and the contact member moves from the first position to a second position with the coupling member being in contact with the contact member when the head assembly is installed in the installation base, and the urging member urges the contact member in a direction from the second position toward the first position.

5. The inkjet recording apparatus according to claim 1, wherein the head assembly includes:

a base member; and a coupling member that couples the recording head to the base member, the coupling member is provided with the insertion hole, and the regulation section presses the coupling member.

6. The inkjet recording apparatus according to claim 1, further comprising an angle adjustment mechanism that is provided for the installation base and configured to adjust an angle of the head assembly, wherein the angle adjustment mechanism rotates the head assembly about the positioning member as a rotation center.

7. The inkjet recording apparatus according to claim 1, wherein the recording head includes a nozzle surface in which nozzle orifices are formed, the installation base includes a bottom wall, the bottom wall includes an opening, and an end of the recording head on a side of the nozzle surface protrudes from the opening.

8. The inkjet recording apparatus according to claim 1, comprising as the recording head a plurality of recording heads that are arranged in the pressing direction.

* * * * *